US006817939B2

(12) United States Patent
Gan et al.

(10) Patent No.: US 6,817,939 B2
(45) Date of Patent: Nov. 16, 2004

(54) FAN HOLDER

(75) Inventors: Li Yuan Gan, Shenzhen (CN); Guang Yi Zhang, Shenzhen (CN); Lu Sheng Li, Shenzhen (CN)

(73) Assignee: Hon Hai Precision Ind. Co., LTD, Taipei Hsien (TW)

( * ) Notice: Subject to any disclaimer, the term of this patent is extended or adjusted under 35 U.S.C. 154(b) by 83 days.

(21) Appl. No.: 10/310,261

(22) Filed: Dec. 4, 2002

(65) Prior Publication Data

US 2004/0033139 A1 Feb. 19, 2004

(30) Foreign Application Priority Data

Aug. 13, 2002 (TW) ..... 91212537

(51) Int. Cl.[7] ..... H05K 7/20
(52) U.S. Cl. ..... 454/184; 415/231.1; 361/695
(58) Field of Search ..... 454/184; 361/695; 415/231.1

(56) References Cited

U.S. PATENT DOCUMENTS 4,517,880 A * 5/1985 Buckner et al. ..... 454/184
5,788,566 A * 8/1998 McAnally et al. ..... 454/184
6,213,819 B1 * 4/2001 Fan ..... 439/894
6,236,564 B1 * 5/2001 Fan ..... 361/695
6,343,011 B1 * 1/2002 Yu ..... 361/695
2002/0060900 A1 * 5/2002 Qiu ..... 361/683

* cited by examiner

*Primary Examiner*—Harold Joyce
(74) *Attorney, Agent, or Firm*—Wei Te Chung

(57) ABSTRACT

A holder (30) for securing a fan (40) to a panel (20) of a computer enclosure includes a base (31) for supporting the fan thereon, and a tapered hood-shaped body (33) extending from the base. The body includes a pair of side walls (334, 336), and top and bottom walls (332, 338) respectively connecting between the side walls. A pair of latches (35) extends outwardly from an edge of the top wall that is distal from the base. A pair of retaining slots (37) is respectively defined in the side walls. An actuator (39) extends outwardly from one of the side walls, and includes a handle (393) and a protrusion (392). The panel defines a pair of spaced cutouts (21) engagingly receiving the latches of the holder, a slit (22) snappingly receiving the protrusion of the holder, and a pair of hooks (23) engaging in the slots of the holder.

16 Claims, 3 Drawing Sheets

FAN HOLDER

BACKGROUND OF THE INVENTION

1. Field of the Invention

The present invention relates to holders, and particularly to a holder which readily and firmly secures a fan to a panel of a computer enclosure.

2. Related Art

A typical contemporary personal computer comprises a central processing unit (CPU) and a power supply. Heat is generated by the CPU, and resulting heated air is removed away from the CPU by a fan driven by the power supply.

However, a single fan does not always effectively dissipate large amounts of heated air generated from modern powerful CPUs. Accordingly, a second fan is often installed at an outside panel of a computer enclosure, to bring cooling air into the enclosure. The second fan is generally attached to the enclosure with screws. This conventionally requires a tool. The attachment procedure is unduly tedious and inconvenient, especially when the enclosure is small. Furthermore, other components in the enclosure are prone to be accidentally damaged during the attachment procedure.

Another conventional means of attachment of a fan to a computer enclosure is shown in Taiwan Patent Application No. 88217278. A fan holder comprises four lateral spring hooks and two longitudinal spring hooks. The enclosure defines four lateral and two longitudinal slots therein. The hooks respectively extend through the slots of the enclosure and engage therewith. Thus, the fan is fastened to the enclosure.

The fan holder does not require screws. However, the fan is not easily removable from the enclosure when maintenance or replacement is required.

Thus, a holding means which solves the above-mentioned problems is strongly desired.

SUMMARY OF THE INVENTION

Accordingly, an object of the present invention is to provide a holder which readily and firmly secures a fan to a panel of a computer enclosure.

Another object of the present invention is to provide a holder which allows easy removal of a fan from a panel of a computer enclosure.

To achieve the above-mentioned objects, a holder in accordance with the present invention for securing a fan to a panel of a computer enclosure comprises a base for supporting the fan thereon, and a tapered hood-shaped body extending from the base. The base defines an opening, and four threaded apertures at four corners thereof. The body comprises a pair of side walls, and top and bottom walls respectively connecting between the side walls. A pair of latches extends outwardly from an edge of the top wall that is distal from the base. A pair of retaining slots is respectively defined in the side walls. An actuator extends outwardly from one of the side walls, and comprises a handle and a protrusion. The panel defines a pair of spaced cutouts engagingly receiving the latches of the holder, a slit snappingly receiving the protrusion of the holder, and a pair of hooks engaging in the slots of the holder.

Other objects, advantages and novel features of the present invention will be drawn from the following detailed description of a preferred embodiment of the present invention with attached drawings, in which:

DESCRIPTION OF THE PREFERRED EMBODIMENT

Figure 1:
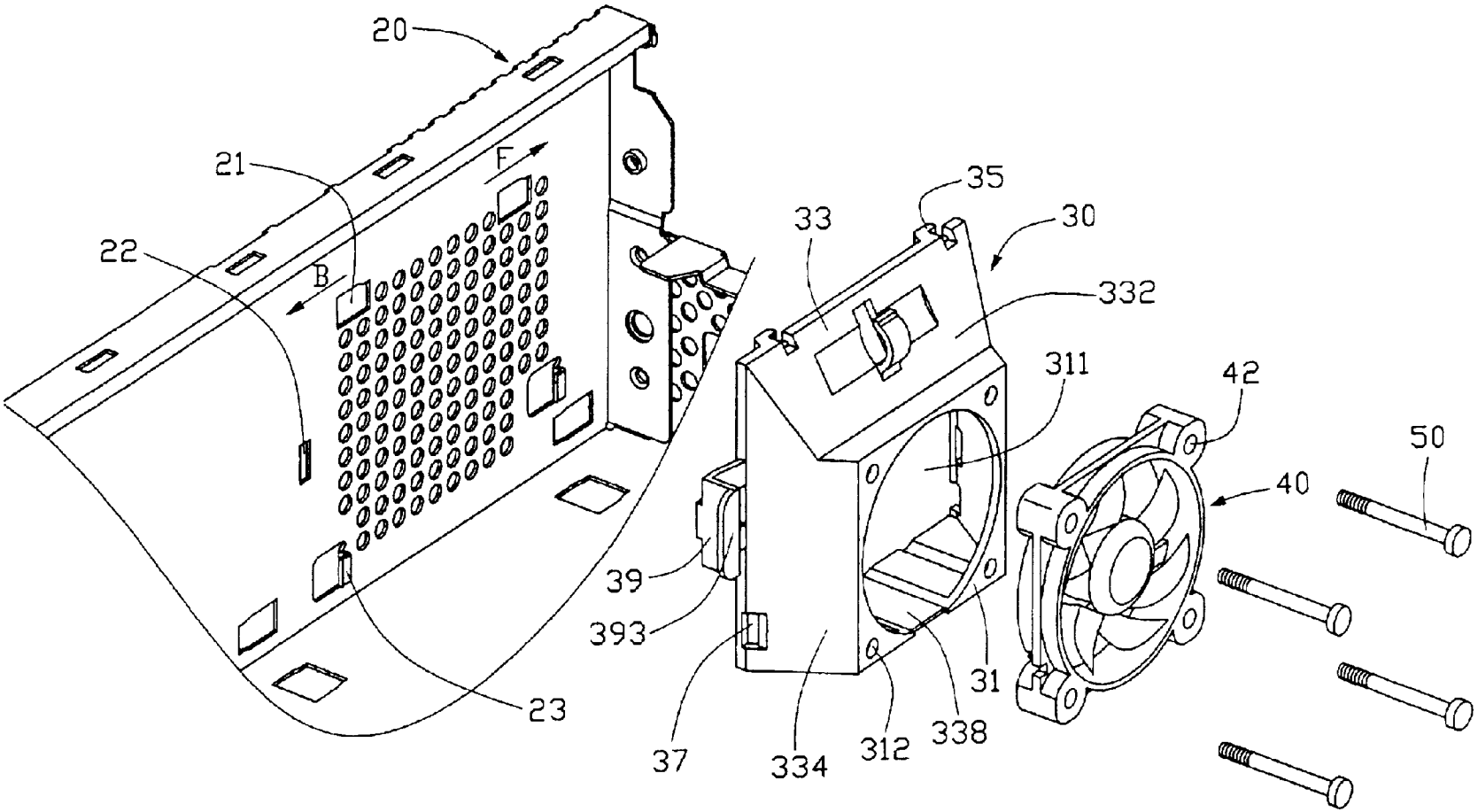
FIG. 1 is an exploded isometric view of a fan holder of the present invention, together with a panel of a computer enclosure, a fan and a plurality of screws.

Referring to FIG. 1, a holder 30 of the present invention is used to secure a fan 40 to a panel 20 of a computer enclosure (not labeled).

Figure 2:
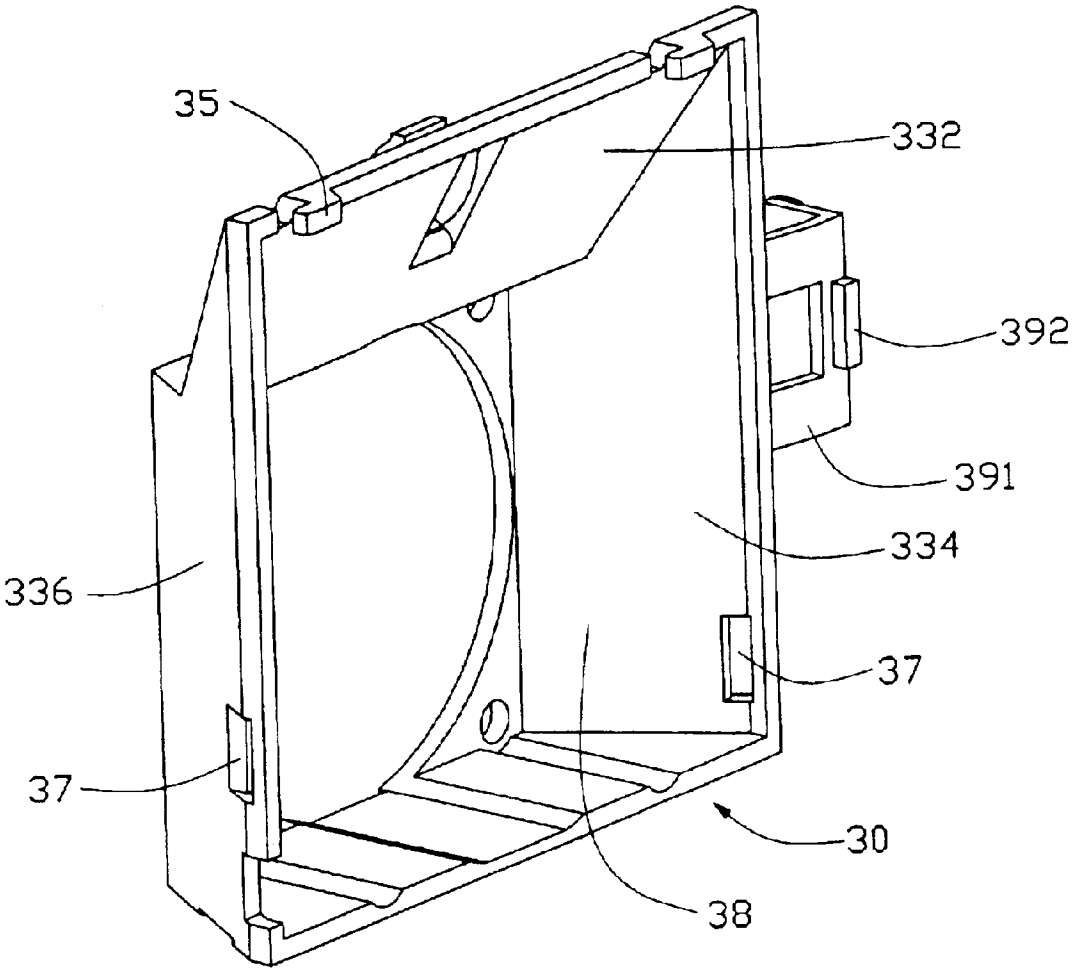
FIG. 2 is an enlarged isometric view of the fan holder of FIG. 1, viewed from another aspect.

Referring also to FIG. 2, the holder 30 comprises a rectangular base 31 and a tapered hood-shaped body 33 extending from the base 31. The base 31 defines an opening 311, and four threaded apertures 312 at four corners thereof respectively. The body 33 comprises a pair of side walls 334, 336, and top and bottom walls 332, 338 respectively connecting between the side walls 334, 336. The walls 332, 334, 336, 338 and the base 31 cooperatively define a cavity 38 therebetween. A pair of spaced L-shaped latches 35 extends outwardly from an edge (not labeled) of the top wall 33 that is distal from the base 31. The latches 35 generally extend in a direction F (see FIG. 1). A pair of retaining holes 37 is respectively defined in lower portions of the side walls 334, 336. In the preferred embodiment, the retaining holes 37 are retaining slots 37. An actuator 39 extends outwardly from the side wall 334. The actuator 39 comprises an L-shaped section 391 extending from the side wall 334, a handle 393 extending perpendicularly from a distal end of the L-shaped section 391, and a protrusion 392 protruding from an elbow of the L-shaped section 391 and perpendicular to the handle 393. The handle 393 is accordingly parallel to the base 31, and the protrusion 392 is accordingly perpendicular to the base 31.

The panel 20 defines a pair of spaced cutouts 21 corresponding to the latches 35 of the holder 30, and a slit 22 generally below one of the cutouts 21 and corresponding to the protrusion 392 of the holder 30. A pair of hooks 23 extends inwardly from a lower portion of the panel 20, corresponding to the slots 37 of the holder 30. The hooks 23 generally extend in a direction B (see FIG. 1).

The fan 40 defines four through apertures 42 at four corners thereof respectively. Four fasteners 50 are provided. In the preferred embodiment, the fasteners 50 are screws 50.

Figure 4:
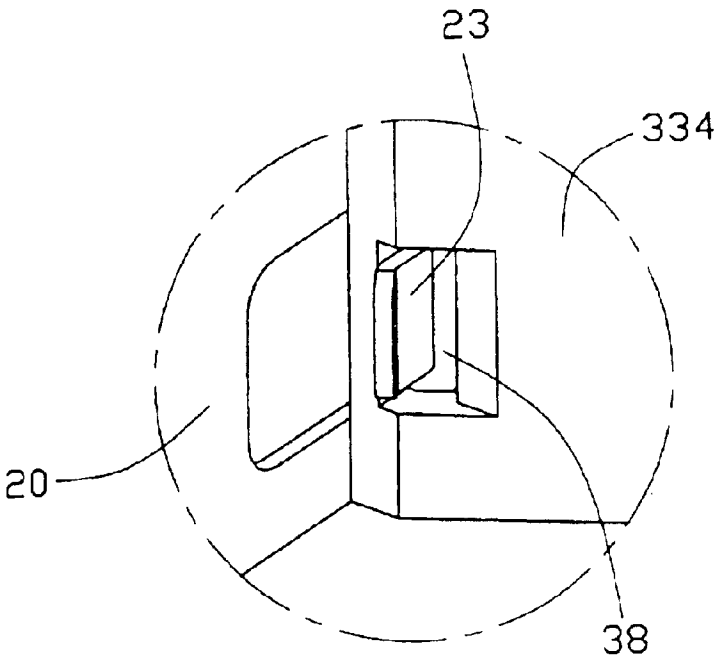
FIG. 4 is an enlarged view of a circled portion IV of FIG. 3.
Figure 3:
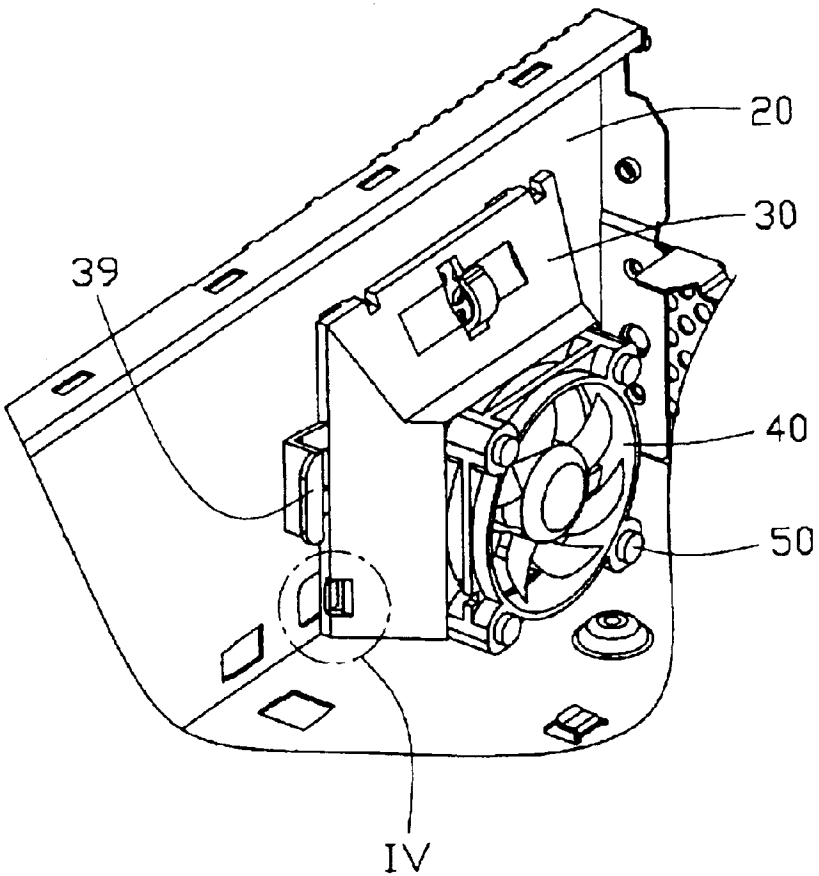
FIG. 3 is an assembled view of FIG. 1.

Referring also to FIGS. 3 and 4, in assembly, the fan 40 is placed on the base 31 of the holder 30. The screws 50 are respectively extended through the through apertures 42 of the fan 40 and engaged in the threaded apertures 312 of the holder 30. The fan 40 is thus securely attached to the holder 30. The combined holder 30 and fan 40 is then placed on the panel 20. The slots 37 of the holder 30 receive the hooks 23 of the panel 20. The cutouts 21 of the panel 20 receive the latches 35 of the holder 30. The holder 30 is pushed in direction F (see FIG. 1). As a result, the hooks 23 engage in the slots 37 of the holder 30, and the latches 35 engage in the cutouts 21 of the panel 20. The handle 393 of the actuator 39 of the holder 30 is pushed toward the panel 20, so that the protrusion 392 of the actuator 39 snappingly engages in the slit 22 of the panel 20. Thus, the combined holder 30 and fan 40 is securely attached to the panel 20.

In disassembly, the handle 393 of the actuator 39 of the holder 30 is pulled away from the panel 20, so that the protrusion 392 escapes from the slit 22 of the panel 20. The holder 30 is pushed in direction B (see FIG. 1). As a result, the latches 35 are disengaged from the cutouts 21 of the panel 20, and the hooks 23 are disengaged from the slots 37 of the holder 30. The combined holder 30 and fan 40 is then easily removed from the panel 20.

It is understood that the invention may be embodied in other forms without departing from the spirit thereof. Thus, the present example and embodiment is to be considered in all respects as illustrative and not restrictive, and the invention is not to be limited to the details given herein.

What is claimed is:

1. A holder adapted to secure a fan to a panel of a computer enclosure, the holder comprising:

a base portion for supporting a fan thereon; and a body portion adjoining the base portion and comprising a plurality of walls, and at least one latch provided at least one of the walls for engaging with the panel, at least one hole being defined in at least one of the walls for engagement of the panel thereat, the body portion further comprising an actuator having an engaging means for engaging with the panel.

2. The holder as described in claim 1, wherein the base portion defines an opening for facilitating airflow of the fan.

3. The holder as described in claim 1, wherein the plurality of walls comprises a pair of side walls, and a top wall and a bottom wall connecting between the side walls, said walls and the base portion cooperatively defining a cavity therebetween.

4. The holder as described in claim 3, wherein the body portion comprises two latches extending from the top wall.

5. The holder as described in claim 3, wherein the body portion defines two holes in lower portions of the side walls respectively.

6. The holder as described in claim 3, wherein the actuator extends from one of the side walls, the actuator comprises a generally L-shaped section and a handle extending perpendicularly from a distal end of the generally L-shaped section, and the engaging means protrudes from the generally L-shaped section.

7. The holder as described in claim 6, wherein the engaging means is a protrusion.

8. A fan holder assembly comprising:

a holder comprising:

a base portion defining a plurality of first apertures; and a body portion adjoining the base portion and comprising a plurality of walls and at least one latch extending from at least one of the walls generally in a first direction, at least one hole being defined in at least another one of the walls, the body portion further comprising an actuator having a first engaging means;

a fan defining a plurality of second apertures;

a plurality of fasteners extending through the second and first apertures and thereby attaching the fan to the base portion of the holder; and a panel defining at least one cutout engagingly receiving the at least one latch of the holder, the panel comprising at least one hook engaging in the at least one hole of the holder, and further comprising a second engaging means interengaging the first engaging means of the holder, whereby the body portion of the holder is secured to the panel.

9. The fan holder assembly as described in claim 8, wherein when the actuator is pulled away from the panel to release the first engaging means from the second engaging means, the holder is movable in a second direction opposite to the first direction to disengage the at least one latch from the at least one cutout and the at least one hook from the at least one hole, thereby releasing the holder from the panel.

10. The fan holder assembly as described in claim 8, wherein the base portion defines an opening for facilitating airflow of the fan.

11. The fan holder assembly as described in claim 10, wherein the plurality of walls comprises a pair of side walls, and a top wall and a bottom wall connecting between the side walls, said walls and the base portion cooperatively defining a cavity therebetween.

12. The fan holder assembly as described in claim 11, wherein the body portion comprises two latches extending from the top wall, and the panel defines two cutouts engagingly receiving the latches.

13. The fan holder assembly as described in claim 11, wherein the body portion defines two holes in lower portions of the side walls respectively, and the panel comprises two hooks engaging in the holes.

14. The fan holder assembly as described in claim 11, wherein the actuator extends from one of the side walls, the actuator comprises a generally L-shaped section and a handle extending perpendicularly from a distal end of the generally L-shaped section, and the first engaging means is provided at the generally L-shaped section.

15. The fan holder assembly as described in claim 14, wherein the first and second engaging means complementarily and interchangably comprise a protrusion extending in a direction perpendicular to the handle, and a slit engagingly receiving the protrusion.

16. A fan holder assembly comprising:

a panel defining an aperture area with first, second and third sets of locking holes surrounding said aperture area;

a holder with a fan thereon, attached to the panel in alignment with said aperture area, said holder including latches hooked in the corresponding first set of locking holes, and retaining slots engaged with corresponding hooks around the second set of locking holes, wherein arrangement between the latches and the first set of locking holes and that between the hooks and the retaining slots allow the holder to be assembled to the panel in a first direction parallel to the panel and locked in a second direction perpendicular to said first direction when said holder is in a locked position, said holder further including an actuator deflectable in the second direction with a protrusion releasably retainably received in the third set of locking hole.

* * * * *